US005435443A

United States Patent [19]

Hohenester et al.

[11] Patent Number: 5,435,443

[45] Date of Patent: Jul. 25, 1995

[54] METHOD AND APPARATUS FOR SEPARATING MIXTURES OF SUBSTANCES

[76] Inventors: Hermann Hohenester, Strasse 21, D-84508 Burgkirchen; Helmut Reisser, Rosenstrasse 6, D-82067 Ebenhausen, both of Germany

[21] Appl. No.: 144,233

[22] Filed: Nov. 3, 1993

[30] Foreign Application Priority Data

Nov. 3, 1992 [DE] Germany ..... 42 37 115.5

[51] Int. Cl.[6] ..... B03B 5/30; B03B 1/06

[52] U.S. Cl. ..... 209/164; 209/162; 209/172; 209/1; 209/2; 209/11; 426/417

[58] Field of Search ..... 209/162, 164, 172, 11, 209/1, 2; 426/417

[56] References Cited

U.S. PATENT DOCUMENTS

| | | |
|---|---|---|
| 2,051,676 | 8/1936 | Bloedorn . |
| 3,722,035 | 3/1973 | Hanks . |
| 3,773,175 | 11/1973 | Wallace . |
| 4,082,655 | 4/1978 | Toledo . |
| 4,226,475 | 10/1980 | Frosch . |
| 4,253,941 | 3/1981 | Lawson . |
| 4,259,179 | 3/1981 | Marvin . |
| 4,260,639 | 4/1981 | Zodel . |
| 4,278,012 | 7/1981 | Wheldon . |
| 4,281,171 | 7/1981 | Sims . |
| 4,375,264 | 3/1983 | Porter . |
| 4,522,628 | 6/1985 | Savins . |
| 4,613,429 | 9/1986 | Chiang . |
| 4,676,804 | 6/1987 | Miller . |
| 4,695,372 | 9/1987 | Warzinski . |
| 4,705,530 | 11/1987 | Blytas . |
| 4,877,530 | 10/1989 | Moses . |
| 4,892,648 | 1/1990 | Kulkarni . |
| 5,032,257 | 7/1991 | Kulkarni . |
| 5,055,184 | 10/1991 | Carpenter et al. ..... 210/109 |
| 5,126,058 | 6/1992 | Beckman . |
| 5,312,549 | 5/1994 | String . |

*Primary Examiner*—Thomas M. Lithgow
*Attorney, Agent, or Firm*—Foley & Lardner

[57] ABSTRACT

The invention proposes using liquefied carbon dioxide as a separation agent for flotation and/or sedimentation separation, which is particularly suitable for separating foodstuff mixtures such as meat components, because it can be maintained in liquid phase at the freezing point of water and is inert with respect to many substances of the mixture. By controlling the pressure and/or the temperature at values of about 26 bar and −14° C., the density of the separation agent can be adjusted to correspond to that of water so that water containing substances of the mixture can be readily separated.

9 Claims, 1 Drawing Sheet

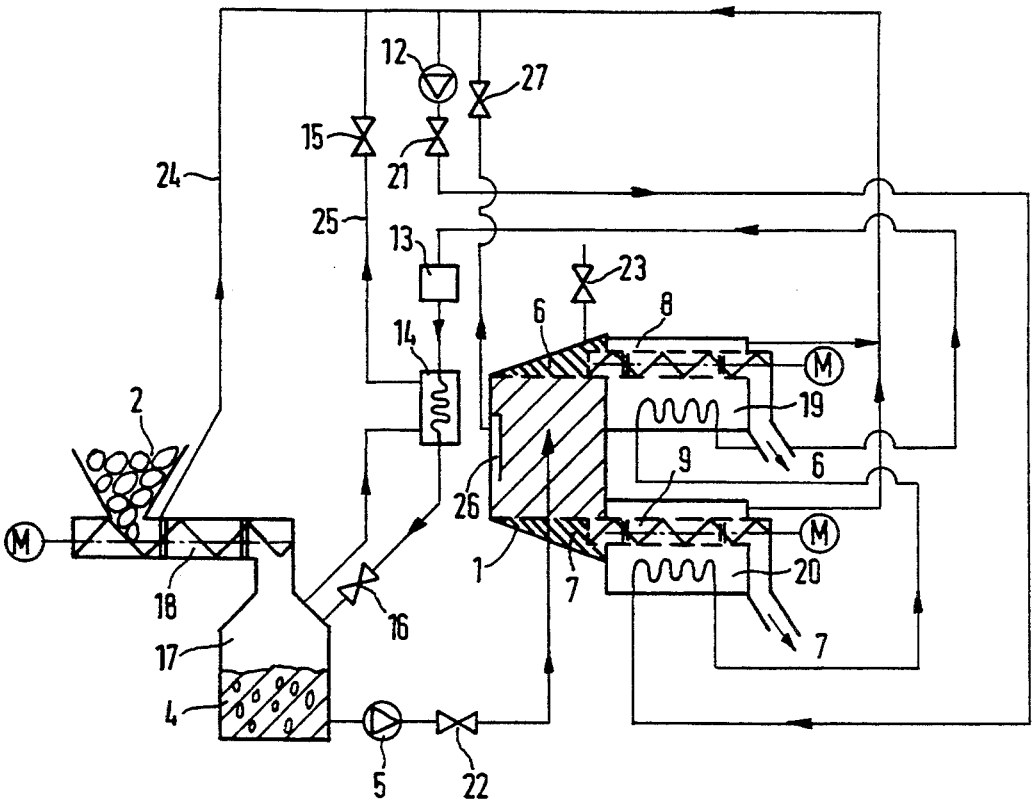
12
27
15
21
24
25
13
23
6
8
14
M
19
2
6
9
26
M
M
1
7
20
18
16
17
7
4
5
22

METHOD AND APPARATUS FOR SEPARATING MIXTURES OF SUBSTANCES

BACKGROUND OF THE INVENTION

The invention relates to a method and an apparatus for separation of mixtures of substances by means of flotation and/or sedimentation.

Such separation processes are widely used in ore processing to separate the ore from dead rock and in the paper industry to recover fibre components from white water or waste paper pulp.

In these methods, the mixture of substances to be separated is fed into a container which includes the separation agent (water in most cases) and in which the mixture separates to form a flotation concentrate which is collected at the surface and/or a sediment which settles at the bottom of the container.

By appropriately shaping the container and providing suitable installations, the separation agent released from the mixture by the above process can be extracted from the container in a substantially clean form and re-used.

It is also known that flotation and sedimentation processes can be enhanced by selecting appropriate flow conditions for the separation agent and by adding chemicals which adapt the process to individual substances or may result in a flocculation of substances to be floated.

Particularly short flotation times and improved results for specific substances can be obtained by gas flotation wherein the mixture containing the substances to be separated and the separation agent is saturated by pressurised gas (mostly air). When the pressure is released the gas forms small bubbles which will more rapidly carry components of the mixture to the surface.

U.S. Pat. No. 5,055,184 discloses embodiments of a separation tank and apparatus which render the discharge of the flotation and/or sedimentation concentrate particularly easy.

All known flotation and sedimentation methods have the disadvantage that parameters of the separation agent which influence the process cannot be altered once the process has started unless chemicals are added which, however, result in undesired residues in the flotation or sedimentation concentrate.

For this reason, the range of application of the known processes is limited and largely unsuited for separating biological substances and foodstuffs.

For food, there is the further difficulty that known apparatus use water as the separation agent, which alters the consistency of the mixture components or may not be separated from them in an economic way. When minced meat is processed to remove undesired fat or cartilage components, it may not be sold as "meat" but only as a "meat product" according to German food regulations. This involves substantial economical losses. The same is true with many natural substances and other complex mixtures of substances. When water is used as a separation agent, cooling to temperatures below 0° C., as is required for some separation processes, is impossible.

SUMMARY OF THE INVENTION

It is an object of the invention to overcome these disadvantages and to provide a separation agent for a flotation and/or sedimentation process which provides greater flexibility in adapting the parameters of the separation process to the specific substances, wherein the separation agent can be removed without altering the compounds of the mixture in the flotation or sedimentation concentrate which can thus be further processed in an economical way.

According to the invention, this object is achieved by using $CO_2$ as the separation agent. A considerable advantage of liquefied carbon dioxide resides in the fact that it can be maintained in a liquid phase at and below the freezing point of water and at readily achievable pressures. Also, liquefied carbon dioxide is inert with respect to most substances, particularly foodstuffs such as mean, and its physical-chemical structure is such that its density can be changed within the limits required for the desired separation effect by changing the process parameters, i.e. pressure and/or temperature. Since the mean or other foodstuff leaves the process in frozen form, it may be readily stored with no additional cooling being required.

The separation agent according to the invention is preferably used at a temperature of about −20° C. to −10° C., more preferably −15° C. to −12° C., particularly at −13.6° C., and the pressure is preferably −15 to 50 bar, more preferably 20 to 30 bar, particularly 26 bar. Under these conditions, liquefied carbon dioxide has the same density as water so that separation products containing water, such as meat components, can be separated. The above-mentioned temperature and pressure ranges are particularly suitable for separation of fat from lean meat.

The separation apparatus of the invention comprises a separation chamber, first inlet means for supplying the mixture of substances to be separated to the separation chamber, second inlet means for supplying liquefied carbon dioxide as a separation agent to the separation chamber, first outlet means for discharging a fraction of the mixture of substances, and second outlet means for discharging a component containing carbon dioxide.

In a preferred embodiment, the apparatus is provided with means for regulating the temperature and/or the conveying ratio between the supplied and the discharged substances. This has the advantage that the conditions within the separation chamber can be adapted to the components of the mixture to be separated. Further, providing heat exchangers in the region of the discharge of the sedimentation or flotation products enables a recovery of a portion of the energy so that the overall loss is minimised.

BRIEF DESCRIPTION OF THE DRAWING

In the following the invention will be explained with reference to the accompanying drawing the sole FIGURE of which shows a diagram of a separation apparatus according to an embodiment of the invention.

DETAILED DESCRIPTION OF THE PREFERRED EMBODIMENT

The separation apparatus shown in the drawing includes a separation chamber 1 which is under pressure and into which a mixture 2 of the substances to be separated is supplied together with liquefied carbon dioxide as a separation agent 4 via an inlet unit including a pump 5 and a valve 22. The flotation concentrate 6 which rises and the sediment 7 which precipitates are separated in the chamber 1. The flotation concentrate 6 is discharged via a discharge unit 8 connected to an upper portion of the separation chamber 1, and the sedimentation concentrate 7 is discharged via a discharge unit 9 connected to a lower portion of the separation chamber 1.

The pressure and temperature within the chamber 1 are adjusted so that the density of the separation agent equals that of one of the components of the mixture to be separated or is between them. As a result, at least one of the components will be caused to float or settle. The adjustment is done by properly selecting the temperature of the supplied mixture on the one hand, and adjusting the conveying ratio of the inlet pump 5 and discharge units 8 and 9 on the other hand. The temperature can be selected So that small gas bubbles are formed by evaporation on the surface of the warmer components of the mixture when the separation agent is added to the mixture of substances. An additional separation effect is thereby achieved.

The discharge units 8 and 9, which are formed by motor driven screw conveyors and act as pressure locks, feed the flotation concentrate 6 and the sediment 7 through heat changers 19 and 20 which collect liquid and evaporated carbon dioxide.

In the heat exchangers 19 and 20, the liquid separation agent dropping off the separated substances evaporates and thereby pre-cools the gaseous separation agent which has been compressed and heated by a compressor 12. The evaporated separation agent is fed to the suction side of the compressor 12. The pre-cooled separation agent flows to a collector 13. where components of the mixture which may have been entrained by the separation agent are precipitated.

The pro-cooled and purified separation agent which is still gaseous then reaches a heat exchanger 14 in which it is further cooled by a counter-current controlled by means of a valve 15. The cooling is conducted to such an extent that the separation agent is liquefied downstream of an expansion valve 16. The liquefied separation agent is collected in a supply container 17 to which the mixture 2 is delivered by a feeder 18 formed by a screw conveyor.

A filter unit 26 is provided in the separation chamber 1 through which pure carbon dioxide can be recovered and supplied via a bypass valve 27 to the suction side of the compressor 12. With given amounts of separation agent and flotation and/or sedimentation concentrate discharged from the separation chamber and a given amount of mixture and separation agent supplied from the container 17, the opening of the valve 27 is controlled so that a predetermined sojourn time within the separation chamber 1 is adjusted. When separating food components, the sojourn time is preferably about one minute.

In case the apparatus is used for separating meat, a temperature of about −50° C. and a pressure of 2 to 6 bar is set within the supply container 17. The temperature inside the separation chamber 1 is about −15° C. and the pressure is 26 bar.

The feeder 18 of the supply container 17 for the mixture of substances is adapted to allow pre-cooling of the mixture by means of evaporating separation agent. Leakage of evaporated separation agent from the closed circuit is prevented by extracting the evaporated separation agent through a suction pipe 24 and feeding it back to the compressor 12. The separation agent evaporating in the supply container 17 is recycled via a suction pipe 25, thereby cooling the pressurised separation agent in the heat exchanger 14.

For the separation agent the process is a closed loop, because the amounts of separation agent coming from the feeder 18, the counter-current valve 15, the heat exchangers 19 and 20 are fed back to the suction side of the compressor 12. Any loss of separation agent occurring in the system is replenished via a valve 23 connected to the separation chamber 1. Check valves 21 and 22 serve to separate the high and low pressure sides of the apparatus from each other.

What is claimed is:

1. A separation process for separating a first solid from a second solid, said first and second solids being components of a foodstuff and having different densities, comprising the steps of subjecting said solids to liquefied carbon dioxide at a temperature between −10° C. and −20° C. and a pressure of 15 to 50 bar, recovering the less dense solid as a float product from said liquid carbon dioxide and recovering the denser solid as a sediment product.

2. The method of claim 1, wherein said foodstuffs comprise components of meat.

3. The method of claim 1, wherein said temperature is between −14° C. and −13° C. and said pressure is between 20 and 30 bar.

4. Apparatus for separating a first solid foodstuff from a second solid foodstuff having a density different than the density of said first solid foodstuff by subjecting the solids to liquefied carbon dioxide at a temperature between −10° and −20° C. and a pressure of 15 to 50 bar, comprising:

a separation chamber containing said first and second solid foodstuff and liquid carbon dioxide at a temperature of between −10° C. and −20° C. and a pressure of 15–50 bars, inlet means for supplying to said separation chamber a mixture of said first and second solid foodstuffs together with said liquefied carbon dioxide at said recited temperature and pressure, first discharge means communicating with said separation chamber for discharging a solid flotation concentrate from an upper portion of said separation chamber, and second discharge means communicating with said separation chamber for discharging a solid sedimentation concentrate having a density equal to or greater than the density of said liquefied carbon dioxide.

5. The apparatus of claim 4, further comprising means for controlling the temperature of said liquefied carbon dioxide supplied to said separation chamber.

6. The apparatus of claim 5, further comprising means for controlling the feed ratio between the solid foodstuffs supplied to said separation chamber and said concentrates discharged from said separation chamber by said first and second discharge means.

7. The apparatus of claim 4, further comprising a supply container to which a mixture of foodstuffs to be separated is fed together with separately fed liquid carbon dioxide, said supply container having an outlet through which said mixture and said liquefied carbon dioxide is fed to said inlet means of said separation chamber.

8. The apparatus of claim 4, wherein said carbon dioxide is discharged from said separation chamber with said solid sedimentation concentrate through said second discharge means, and further including a compressor to which is fed evaporated carbon dioxide formed by a heat exchanger in flow communication with said liquefied carbon dioxide discharged through said second discharge means.

9. The apparatus of claim 4, wherein said first and second discharge means include screw conveyors which act as pressure locks to maintain temperature and pressure levels in said separation chamber.

* * * * *